United States Patent [19]

Krout

[11] Patent Number: 4,476,993

[45] Date of Patent: Oct. 16, 1984

[54] TAMPERPROOF LID

[76] Inventor: Gerald R. Krout, Rte. 1, Box 198A, Sawyerville, Ala. 36776

[21] Appl. No.: 539,414

[22] Filed: Oct. 6, 1983

[51] Int. Cl.[3] ..... B65D 17/40

[52] U.S. Cl. ..... 220/276; 220/270; 220/306; 215/256

[58] Field of Search ..... 220/270, 276, 306, 309; 215/256

[56] References Cited

U.S. PATENT DOCUMENTS

| | | | |
|---|---|---|---|
| 3,589,551 | 6/1971 | Haggbom | 220/309 |
| 3,653,529 | 4/1972 | Segmuller | 215/256 |
| 3,831,798 | 8/1974 | Rowe et al. | 215/256 |
| 4,103,803 | 8/1978 | Irvine | 215/256 |

*Primary Examiner*—George T. Hall

*Attorney, Agent, or Firm*—LeBlanc, Nolan, Shur & Nies

[57] ABSTRACT

A tamperproof lid for a container, in which a toothed ring portion must be substantially completely removed from its connection to the remainder of the lid and also from contact with the rim of the container in order to open the container, thus providing protection against tampering with the contents of the container. The lower portion of the lid outer periphery is provided with toothed or segmented sections extending around the circumference of the lid. Upon an attempt being made to raise the lid, the teeth will engage the lower surface of the container rim in a tight, firm construction which tends to hold more tightly as any attempt is made to remove the lid. Thus the lid of the invention may not be removed without destroying the seal which the lid makes with the rim of the container.

14 Claims, 4 Drawing Figures

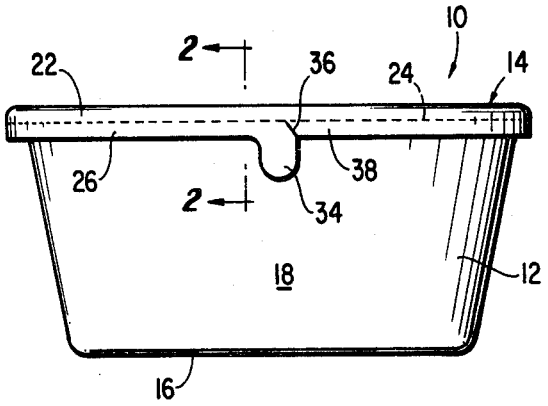
FIG. 1
FIG. 2
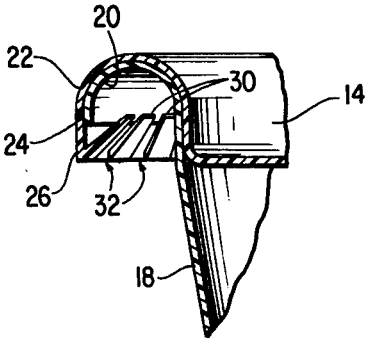
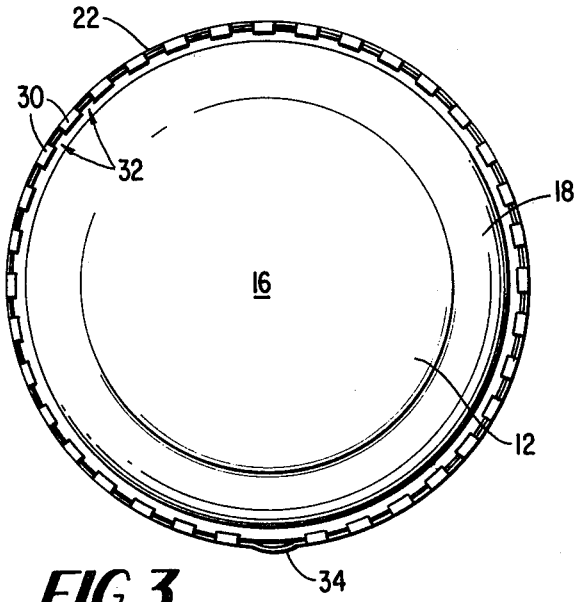
FIG. 3
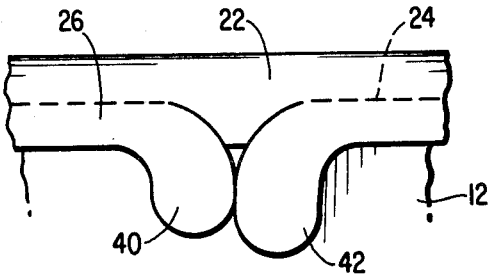
FIG. 4

TAMPERPROOF LID

BACKGROUND AND SUMMARY OF THE INVENTION

The present invention relates to a tamperproof lid for a container. More particularly, the present invention relates to a tamperproof lid in which a lower ring portion must be substantially completely removed from its connection to the remainder of the lid and also from contact with the upper lip of the container in order to open the container, thus providing a means of protecting against tampering with the contents of the container.

Previous containers having tamperproof lid constructions are described, for example, in the following U.S. Pat. Nos. 3,974,932 to Faulstich; 4,341,318 to Smalley; 4,305,517 to Dennis; 4,281,774 to Mumford; 4,111,329 to Lampman; and 4,103,803 to Irvine. Other closure mechanisms in which a tear strip is provided for removing the cover therefrom are described, for example, in the following U.S. Pat. Nos.: 3,172,557 to Koenig; 3,347,407 to Coolidge; 3,356,250 to Russell; 3,416,697 to Ledzion; and 3,425,592 to Vogel.

By the present invention, there is provided an improved tamperproof lid for a container, wherein a series of toothed or segmented sections are provided around the lower portion of the lid outer periphery which grips the lip or rim of the container. This toothed portion of the lid forms a portion of the tear strip which must be removed in order to remove the lid.

The teeth of the segmented sections of the lid are formed so that, upon an attempt being made to raise the lid, the teeth will engage the lower surface of the rim around the upper periphery of the container in a tight, firm construction which tends to hold more tightly to the rim of the container as any attempt is made to remove the lid. Thus the lid of the present invention may not be removed without destroying the seal provided around the lip or rim of the container. Whereas with other constructions a squeeze type effect is produced, in the present invention there is a finger-like pulling effect so that the harder one pulls, the more tightly the lid construction will hold to the rim of the container.

The tamperproof lid of the present invention thus provides a positive lock which does not depend upon friction or the resilience of the lid or cap. In one embodiment, the lid may be constructed of polyethylene in a thickness of from about 0.008 to 0.015 inches in thickness.

Accordingly, it is a primary object of the present invention to provide a lid for a container in which the lid will give evidence of tampering or an attempt to open the lid.

It is another object of the invention to provide a positive lock-type lid for a container which will adhere closely and tightly to the rim of the container.

It is a further object of the invention to provide a tamperproof lid which may be easily employed with present capping equipment resulting in a simple and effective means of closure for a container.

It is another object of the invention to provide a lid member having a series of toothed segments or portions which assist in maintaining closure of the container while also providing a means of tension to prevent lid removal in the event of tampering.

BRIEF DESCRIPTION OF THE DRAWINGS

FIG. 1 is a side elevation showing a container with the tamperproof lid of the present invention installed thereon.

FIG. 2 is a partial cross-sectional view taken along line 2—2 of FIG. 1.

FIG. 3 is a bottom view showing a portion of the underside of the segmented lid as installed upon the container.

FIG. 4 is an enlarged view of an alternative embodiment of the tab construction which forms a pair of grips for tearing off the peripheral edge of the rim of the lid shown in FIG. 1.

DESCRIPTION OF THE PREFERRED EMBODIMENTS

In the embodiment of the invention as shown in FIGS. 1–3, there is provided a tamperproof lid construction 10 including a container 12 having a lid 14 in accordance with the present invention installed thereon. The container 12 includes a bottom wall 16 and upstanding, slightly outwardly inclined side walls 18 which, as best shown in FIGS. 1–3, are turned outwardly and then downwardly at the upper end portions thereof to form a shoulder or lip 20 of approximately semi-circular cross-section for use in receiving the lid 14 of the invention. The lip 20 should be generally concave relative to the lower end of the container 12, however the lip 20 could be flat with square corners.

As shown in FIG. 2, the lid 14 extends across the open top of the container 12, closing this open top and engaging the container 12 at its inner surface in the vicinity of its open top, and the lid 14 has an outer periphery 22 which extends along and is situated directly over the lip 20. At its inner surface the periphery 22 of the lid 14 is scored so as to have an elongated groove 24 which provides the lid 14 with a line of weakness. Thus the portion 26 of the periphery 22 of the lid 14 which is located beyond the groove 24 forms a tear strip structure capable of being torn from the lid 14, so that the latter can then be removed from the container 12.

The lower end portion of the tear strip structure 26 is formed as a series of uniformly shaped segments or teeth 30 which, in the installed or closed lid position on the container 12, extend inwardly and upwardly relative to the lip 20 of the container. In one embodiment, the base of the teeth 30 commence approximately 1/16 inch below the extreme lower end portion of the lip 20 of the container 12 and the teeth 30 are approximately 3/16 inch wide at the base and with a gap 32 of approximately 5/16 inch between consecutive teeth 30 at the base thereof. In this embodiment, each tooth 30 has a length of approximately 3/16 inch and is tapered inwardly from the base to a width at the outer end of approximately 5/32 inch. Such tapering is not necessary and in other embodiments, the teeth 30 are of uniform width.

The lid 14 with outer periphery 22 and tear strip structure 26 having teeth 30 as described herein may be formed by any suitable method known in the art, such as by injection molding. One such method would include unscrewing injection molding in which, due to the undercuts necessary to form the teeth 30, an inner portion of the mold will be caused to move at the end of the molding cycle, allowing the finished part to be ejected upon opening of the mold. This method is known in the art and is employed in many cap and lid manufacturing applications.

In FIG. 3 there is shown a bottom view of the container 12, with the teeth 30 shown as extending inwardly from the outer periphery 22 of the lid 14 and with a gap 32 between adjacent teeth 30. This arrangement of teeth 30 and gaps 32 extends around the entire circumference of the lid 14.

In the embodiment of FIG. 1, a single, downwardly extending pull tab 34 is provided for use in removing the tear strip structure portion 26 of the lid periphery 22 located below score line 24. The pull tab 34 forms one end of the tear strip 26 and a notch 36 separates the pull tab 34 from the opposite end portion 38 of the tear strip 26. In the embodiment of FIG. 4, a pair of pull tabs 40, 42 are employed, with each pull tab 40, 42 forming a respective end of the tear strip 26.

In applying the lid 14 to the container 12, the teeth 30 will be forced to "fold up" until they pass the rim of the container, at which time the "memory" of the lid material will cause the teeth 30 to return to their molded position. As shown in FIG. 2, adherence of the teeth 30 to the container 12 is not necessary in the closed lid position, as the teeth 30 will engage the underside of the lip 20 in the event of tampering attempts.

In removing the lid 14 from the container 12, the pull tab 34 is grasped by the operator and pulled sharply to the left, relative to the position shown in FIG. 1, thus causing the tear strip 26 to separate from the lid 14 along score line 24 around the circumference of the lid 14. When the tear strip 26 or a substantial portion thereof has been thus separated, the operator may readily lift the lid 14 from the container 12. A similar procedure would be carried out in the embodiment of FIG. 4, with the operator grasping the pull tabs 40, 42 with both hands, respectively, and pulling these tabs 40, 42 apart from each other so as to simultaneously remove the tear strip 26 from the lid 14. It would also be possible for the operator to grasp both pull tabs 40, 42 in one hand and to simultaneously pull and tear the tear strip 26 from the lid 14.

The present invention prevents tampering with the contents of the container 12 since, upon any attempt being made to raise the lid 14 without removing the tear strip 26, the teeth 30 will tightly grip the underside of lip 20. Due to the configuration of the teeth 30 as attached to the lower end of the tear strip structure 26, with the teeth 30 angling upwardly at an angle of about 30 to 90 degrees to the horizontal in the installed position, the teeth 30 will tend to grip the underside of the lip 20 tighter and tighter, so that the lid 14 cannot be removed except upon removal of the tear strip 26 as previously described.

The container 12 to which the lid 14 is attached may be formed of any suitable container material such as metal, glass, plastic or ceramic while the lid 14 itself is preferably constructed of polyethylene or a similar plastic material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A tamperproof container closure comprising: a cover having an outer periphery; tear strip means detachably connected to said cover at said outer periphery thereof to be torn therefrom when the cover is to be removed from a container, said tear strip means having an outer edge portion with a plurality of toothed segments attached to and extending along said outer edge portion, said toothed segments being formed so as to extend generally inwardly and upwardly from the location at which they are attached to said outer edge portion of the tear strip means.

2. The closure of claim 1 wherein the outer periphery of said cover includes a portion which is generally semi-circular in cross-section, open at the lower end, and with the toothed segment portion extending generally inwardly and upwardly from the outer end of said portion of semi-circular cross-section.

3. The closure of claim 1 wherein said outer edge portion forms the lower end of said tear strip means.

4. The closure of claim 1 wherein said toothed segments extend upwardly at an angle of about 30 to 90 degrees relative to the horizontal.

5. The closure of claim 1 wherein a portion of said tear strip means is formed as a lift tab.

6. The closure of claim 5 wherein a pair of lift tabs are formed in said tear strip means.

7. A container and tamperproof lid therefor, comprising: a hollow body having an open upper end with a rim extending around said upper end; and a cover resting on said rim and extending across the open upper end of said body for closing said container, said cover having an outer periphery extending along said rim; and tear strip means detachably connected to said cover at said outer periphery thereof to be torn therefrom when the cover is to be removed, said tear strip means having an outer edge portion with a plurality of toothed segments attached to and extending along said outer edge portion.

8. The container of claim 7 wherein said toothed segments are formed so as to extend generally inwardly and upwardly from the location at which they are attached to said outer edge portion of the tear strip means.

9. The container of claim 7 wherein the rim of said body is formed so as to be of a generally concave configuration relative to the lower end of the container body.

10. The container of claim 9 wherein the rim of the container body is of approximately semi-circular cross-section.

11. The container of claim 8 wherein said toothed segments extend upwardly at an angle of about 30 to 90 degrees relative to the horizontal.

12. The container of claim 7 wherein a portion of said tear strip means is formed as a lift tab.

13. The container of claim 12 wherein a pair of lift tabs are formed in said tear strip means.

14. The container of claim 7 wherein the outer periphery of the cover includes a portion which is generally semi-circular in cross-section, open at the lower end, and with the toothed segment portion extending inwardly and upwardly from the outer end of said portion of semi-circular cross-section.

* * * * *